United States Patent [19]

Fraser

[11] 4,153,209

[45] May 8, 1979

[54] GRINDERS

[75] Inventor: Donald S. Fraser, Randburg, South Africa

[73] Assignee: Babcock and Wilcox of Africa, South Africa

[21] Appl. No.: 829,657

[22] Filed: Sep. 1, 1977

[30] Foreign Application Priority Data

Sep. 22, 1976 [ZA] South Africa ..... 76/5692

[51] Int. Cl.[2] ..... B02C 15/00

[52] U.S. Cl. ..... 241/103

[58] Field of Search ..... 241/103, 105, 106

[56] References Cited

U.S. PATENT DOCUMENTS

| | | | |
|---|---|---|---|
| 290,874 | 12/1883 | Feldmann | 241/106 |
| 615,278 | 12/1898 | Johnson | 241/103 |
| 2,906,467 | 9/1959 | Poole | 241/103 |
| 3,044,716 | 7/1962 | Frenkel et al. | 241/103 |

*Primary Examiner*—Robert L. Spicer, Jr.

*Attorney, Agent, or Firm*—McGlew and Tuttle

[57] ABSTRACT

A grinder for material wherein a series of hollow balls is entrained for rotational movement between an upper ring and a lower ring, the rings being relatively rotatable about a control axis, and the balls being rotatable between the rings, and the material for grinding being fed into a zone between the balls and rings. The contact zone between the upper ring and each ball is defined by two annular lips and is substantially less than the contact zone between the lower ring and each ball.

1 Claim, 2 Drawing Figures

GRINDERS

BACKGROUND OF THE INVENTION

This invention relates to grinders. In particular the invention is concerned with grinding mills for power and process industries.

DESCRIPTION OF PRIOR ART

One form of mill for such industry is one where coal or the like is fed into a zone to be ground by rotating hollow balls held between retaining rings. The balls in question are caused to rotate by the lower ring which rotates about a central axis, the coal then being ground between balls and rings. The balls and rings naturally wear with grinding and the lifespan of these wearing parts can thus be restricted. When replacement is necessary the grinder is stopped, and besides the cost of replacement there is also a cost in the "down time" which results during the replacement operation.

OBJECT OF THE INVENTION

It has been found in present grinders that the lifespan of the balls and rings is shorter than it may otherwise be and the Applicant has developed an improvement for increasing such lifespan, and thus minimising the disadvantages which are present in current grinders.

SUMMARY OF INVENTION

According to the invention there is provided a grinder for material wherein a series of balls is entrained for movement between an upper ring and a lower ring, the rings being relatively rotatable about a central axis and the balls being rotatable between the rings. The material for grinding is fed into a zone between the balls and rings where grinding is effected and a contact zone between the upper ring and each ball is provided which is substantially less than the contact zone between the lower ring and each ball.

Further according to the invention the contact zone of the upper ring is defined by two annular lips on the upper ring, the lips being spaced apart such that the angle subtended between them from the ball center is substantially 90°.

Also according to the invention the lips or contact zones of the upper ring are made of a hardened steel or iron.

In some forms of the invention the upper ring is defined as part of a locating spider and contact elements or lips are keyed into such spider.

In cases where there are two lips on the upper ring abutting each ball the contact zone of the upper ring is determined by the sum of the contact areas of each ring on each ball.

The invention is now described with reference to the accompanying drawings.

DESCRIPTION OF PREFERRED EMBODIMENT

Figure 1:
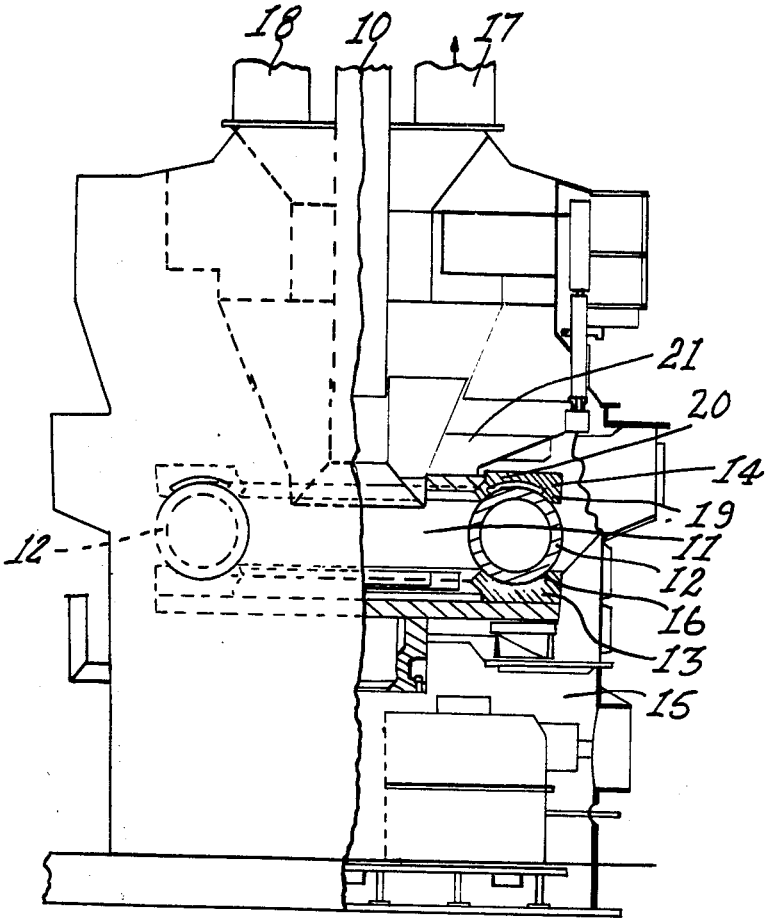
FIG. 1 — a fragmentary elevation of a grinder wherein the upper ring is replaceable below a spider or mounting structure.

Referring to FIG. 1 of the drawing the inlet for coal or coke is defined by chute 10, the coal entering chamber 11 where under centrifugal force it moves outwardly to the hollow balls 12.

Balls 12 are located between a lower ring 13 and upper ring 14 the axis of the ring being substantially in alignment with the central axis of chute 10. A motor and gear box is located in the zone 15 below the lower ring which causes the lower ring 13 to rotate. This in turn causes the balls 12 to move in the track defined by the rings 13 and 14. The mating zone 16 of ring 13 abuts the ball 12 and grinding is effectively carried out in this mating zone 16. Ground or pulverised material is then fed outwardly from the ball and moves upwardly and outwards of the grinder through chutes 17 and 18.

In known arrangements the upper ring 14 abuts the ball substantially over the same arcial distance as the lower ring 13. The Applicant has however found that by reducing this contact area to define two contact zones formed by legs 19 and 20 the wear on the upper ring 14 can be substantially reduced. This wear is reduced on the ball as well as the upper ring 14. These contact zones are the area of the legs 19 and 20 which are in engagement with the grinding balls.

The legs 19 and 20 can be constituted by a hardened steel such as a high chrome iron or steel and in this fashion the rate of wear of the legs can be minimized with the purpose of reducing the differential in life span between the upper and lower rings.

Figure 2:
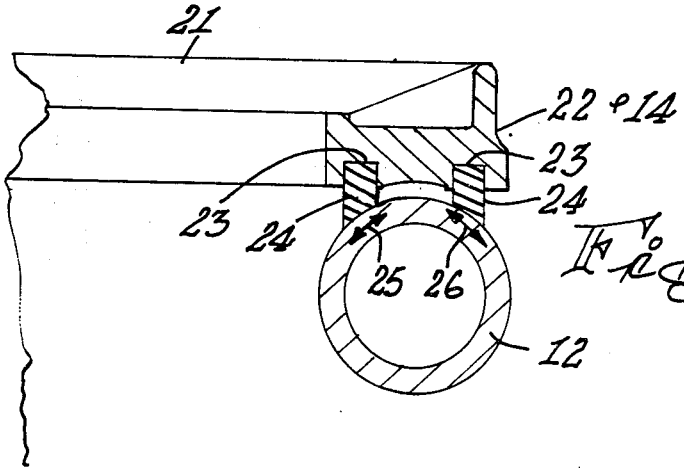
FIG. 2 is a sectional view of a second form of the invention wherein the upper ring forms part of the locating spider and the contact zones is defined by separate annular rings.

In a further refinement of the invention the spider or mounting structure 21 is designed to incorporate an upper ring 14 which bears the reference numeral 22 as illustrated in FIG. 2 to form a spider ring combination in which circumferential slots 23 are provided. The contact elements or lips 24 are then keyed into slots 23 and in this fashion also the cost of the upper ring is reduced. The replacement parts of FIG. 2 are accordingly less. The lips 24 are of identical shape and size and are spaced symmetrically about the pitch circle of the balls 12 so that the angle subtended between them from the ball center is substantially 90°. Lips 24 contact balls 12 along the width of their lower surfaces shown at 25 and 26, respectively.

In a current test with the grinder of the invention it has been found that the indications are that the lifespan of a set of balls and lower and upper rings will be approximately double that of existing arrangements where the top ring fully abuts the ball. In pulverising coal the normal lifespan of two sets of balls one bottom and one top ring would be approximately 14,000 hours and this now appears to be doubled in the current tests. In existing arrangements, since the balls wear more quickly than the rings, each set is referred to as being, two sets of balls, one bottom and one top ring. By comparison in the arrangement of the invention the lifespan of the ball set alone is doubled and thus a set is defined as being one upper ring, one lower ring and one set of balls.

The grinder of the invention may be used for grinding any suitable mineral.

While a specific embodiment of the invention has been shown and described in detail to illustrate the application of the principles of the invention, it will be understood that the invention may be embodied otherwise without departing from such principles.

I claim:

1. A grinder for material wherein a series of balls is entrained for rotational movement between an upper ring and a lower ring, the rings being relatively rotatable about a central axis and the balls being rotatable between the rings, material for grinding being fed into a zone between the balls and rings where grinding is effected, comprising the upper closed ring including two radially spaced replaceable annular lips separately mounted in slots in the upper ring, said annular lips engaging the balls, the contact zone between said annular lips and each ball being substantially less than the contact zone between the lower ring and each ball, said replaceable annular lips being symmetrically disposed about the pitch circle of the balls; said annular lips being spaced apart such that the angle subtended between them from the ball center is substantially 90°, said annular lips being made of a hardened steel, the upper ring comprising a spider through which material to be ground is centrally fed in an area spaced radially inwardly of said annular lips, the upper ring including said radially spaced replaceable annular lips separately mounted in radially spaced annular slots in the upper ring, and the upper ring is defined as part of said locating spider.

* * * * *

UNITED STATES PATENT AND TRADEMARK OFFICE

CERTIFICATE OF CORRECTION

PATENT NO. : 4,153,209

DATED : May 8, 1979

INVENTOR(S) : Donald S. Fraser

It is certified that error appears in the above—identified patent and that said Letters Patent is hereby corrected as shown below:

On The Title Page Item [73] should read

-- Babcock & Wilcox of Africa (Proprietary) Limited --.

Signed and Sealed this

*Twenty-fifth* Day of *December 1979*

[SEAL]

*Attest:*

SIDNEY A. DIAMOND

*Attesting Officer*

*Commissioner of Patents and Trademarks*